US008857570B2

(12) United States Patent
Schwarzentruber

(10) Patent No.: US 8,857,570 B2
(45) **Date of Patent: *Oct. 14, 2014**

(54) LIGHTING COUPLED TO ELEVATOR SYSTEM

(71) Applicants: Inventio AG, Hergiswil (CH); Ingersoll Rand Security Technologies, Carmel, IN (US)

(72) Inventor: Josef Schwarzentruber, Kussnacht a/Rigi (CH)

(73) Assignees: Inventio AG, Hergiswil (CH); Ingersoll Rand Security Technologies, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/952,865

(22) Filed: Jul. 29, 2013

(65) Prior Publication Data

US 2014/0027208 A1 Jan. 30, 2014

Related U.S. Application Data

(63) Continuation of application No. 12/990,063, filed as application No. PCT/EP2008/055194 on Apr. 28, 2008, now Pat. No. 8,528,701.

(51) Int. Cl.

| | |
|---|---|
| ***B66B 1/20*** | (2006.01) |
| ***B66B 1/46*** | (2006.01) |
| ***B66B 1/14*** | (2006.01) |
| ***B66B 1/34*** | (2006.01) |

(52) U.S. Cl.

CPC ..... *B66B 1/14* (2013.01); *B66B 2201/4638* (2013.01); *B66B 1/468* (2013.01); *B66B 2201/4615* (2013.01); *B66B 2201/4676* (2013.01); *B66B 1/3492* (2013.01)

USPC ..... 187/384; 187/391; 362/276

(58) Field of Classification Search

USPC ..... 187/247, 248, 380, 382, 384, 391–393, 187/396; 340/5.1–5.33, 5.61, 5.8, 5.81; 315/307; 362/146, 147, 276, 802

See application file for complete search history.

(56) References Cited

U.S. PATENT DOCUMENTS

| | | | |
|---|---|---|---|
| 3,110,879 | A | 11/1963 | Nikazy |
| 4,979,594 | A | 12/1990 | Begle et al. |

(Continued)

FOREIGN PATENT DOCUMENTS

| | | | |
|---|---|---|---|
| DE | 3124717 | A1 | 1/1983 |
| EP | 0699617 | A1 | 3/1996 |

(Continued)

OTHER PUBLICATIONS

Kone IDE300 Brochure, 2008, pp. 1-8.

*Primary Examiner* — Anthony Salata

(74) *Attorney, Agent, or Firm* — Fraser Clemens Martin & Miller LLC; William J. Clemens

(57) ABSTRACT

A method, a computer-readable data storage device and a system include determining a starting floor level in a building based on a received movement signal for a building door in the building, identifying a lighting unit along a path in the starting level floor between the building door and an elevator door on the starting floor level, and activating the identified lighting unit. The movement signal can be based upon a building door on the starting floor has been opened for a person and in response sending an elevator cabin to the elevator door at the starting floor to receive the person.

20 Claims, 3 Drawing Sheets

(56) References Cited

U.S. PATENT DOCUMENTS

| | | | | |
|---|---|---|---|---|
| 5,099,402 | A | 3/1992 | Starniri | |
| 7,319,383 | B2 | 1/2008 | Howard | |
| 7,717,238 | B2 | 5/2010 | Hamaji et al. | |
| 7,729,691 | B2 | 6/2010 | Newville | |
| 8,290,781 | B2 | 10/2012 | Gazdzinski | |
| 8,528,701 | B2 * | 9/2013 | Schwarzentruber | 187/384 |
| 2011/0160881 | A1 | 6/2011 | Grey | |
| 2012/0153868 | A1 | 6/2012 | Gu et al. | |
| 2012/0181117 | A1 * | 7/2012 | Chasteen | 187/392 |
| 2012/0241259 | A1 | 9/2012 | Flynn et al. | |

FOREIGN PATENT DOCUMENTS

| | | | |
|---|---|---|---|
| FR | 2744435 | A1 | 8/1997 |
| JP | 02310271 | A | 12/1990 |
| JP | 04032470 | A | 2/1992 |
| JP | 04140283 | A | 5/1992 |
| JP | 04144886 | A | 5/1992 |
| JP | 05201633 | A | 8/1993 |
| JP | 05229747 | A | 9/1993 |
| JP | 08310750 | A | 11/1996 |

* cited by examiner 1, 1', 1" floor level
3, 3', 3" elevator door
4, 4', 4", 5, 5', 5" building door
8 elevator car
9 supporting means
10 elevator control
10' control device
11 elevator drive
12 counter weight
30, 30', 30" elevator sensor
31 door mechanism
32 elevator car door sensor
33 car door
40, 40', 40", 50, 50', 50" door sensor
63, 63', 63" terminal
68 terminal
74, 74', 74", 75, 75', 75" electric lighting unit
78 electric lighting unit
80 elevator car sensor 10 elevator control 10' control device
30, 30', 30" elevator sensor
32 elevator car door sensor
40, 40', 40", 50, 50', 50" door sensor
63, 63', 63" terminal 68 terminal
74, 74', 74", 75, 75', 75" electric lighting unit
78 electric lighting unit 80 elevator car sensor

Fig. 5

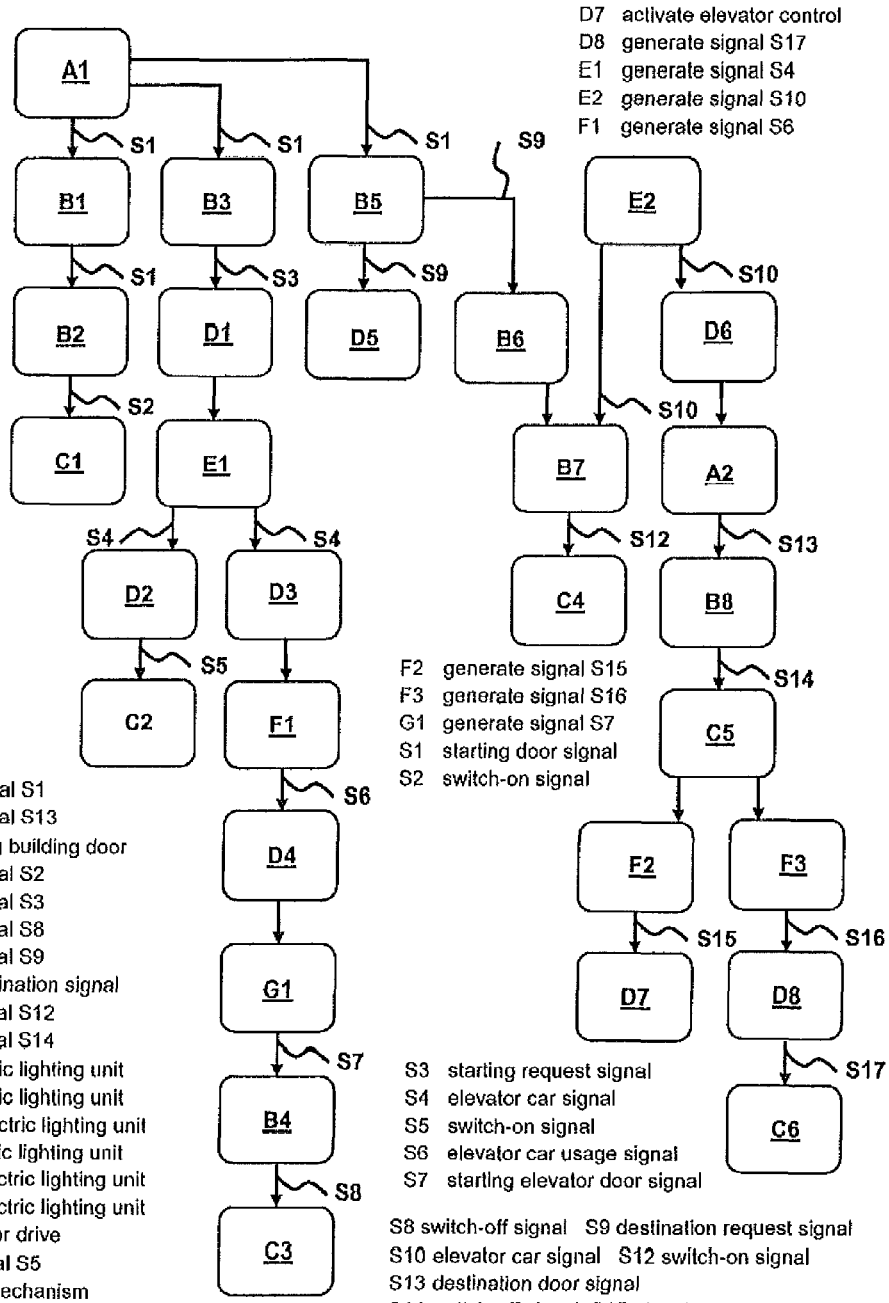

D7 activate elevator control
D8 generate signal S17
E1 generate signal S4
E2 generate signal S10
F1 generate signal S6

F2 generate signal S15
F3 generate signal S16
G1 generate signal S7
S1 starting door signal
S2 switch-on signal A1 generate signal S1
A2 generate signal S13
B1 define starting building door
B2 generate signal S2
B3 generate signal S3
B4 generate signal S8
B5 generate signal S9
B6 generate destination signal
B7 generate signal S12
B8 generate signal S14
C1 activate electric lighting unit
C2 activate electric lighting unit
C3 deactivate electric lighting unit
C4 activate electric lighting unit
C5 deactivate electric lighting unit
C6 deactivate electric lighting unit
D1 control elevator drive
D2 generate signal S5
D3 control door mechanism
D4 control door mechanism
D5 transmit signal S9
D6 control door mechanism S3 starting request signal
S4 elevator car signal
S5 switch-on signal
S6 elevator car usage signal
S7 starting elevator door signal S8 switch-off signal S9 destination request signal
S10 elevator car signal S12 switch-on signal
S13 destination door signal
S14 switch-off signal S15 elevator car usage signal
S16 elevator car usage signal
S17 switch-off signal

LIGHTING COUPLED TO ELEVATOR SYSTEM

CROSS-REFERENCE TO RELATED APPLICATIONS

This application is a continuation of the U.S. patent application Ser. No. 12/990,063, filed Oct. 28, 2010 and now U.S. Pat. No. 8,528,701, that is a 371 of PCT/EP2008/055194 filed Apr. 28, 2008.

FIELD OF THE INVENTION

The invention relates to a method for coupling lighting to an elevator installation and an elevator system for implementing this method.

BACKGROUND OF THE INVENTION

U.S. Pat. No. 3,110,879 A discloses an elevator system, wherein the electric lighting unit in elevator cars is automatically dimmed or switched off when there are no passengers in the elevator cars and wherein the electric lighting unit of the elevator cars is switched on as soon as passengers make elevator requests. Passengers are thus directed to illuminated elevator cars and the elevator cars convey the passengers to their destination.

SUMMARY OF THE INVENTION

The object of the present invention is to develop further this method and this elevator system.

This object is achieved with a method for conveying passengers and a device provided for implementing the method, namely an elevator system comprising the features described below.

As is known, an elevator system is provided for conveying passengers in a building comprising a plurality of floor levels. The building comprises at least one elevator door and at least one building door. At least one elevator control controls at least one elevator drive for moving at least one elevator car. A starting door signal is generated by opening and/or closing a building door.

As soon as the passenger indicates, by opening and/or closing a building door, his desire to cross a door threshold and to use the elevator system, an elevator car is automatically ascertained for him on the basis of the generated starting door signal. For this purpose, the starting building door comprises at least one door sensor which detects the opening and/or closing of the starting building door and generates at least one starting door signal each time it detects that the starting building door has been opened and/or closed. The door sensor can be disposed in the starting building door and/or in proximity to the starting building door. The door sensor detects a minimal amount of movement of a door leaf of the starting building door and thus the passenger's desire to be conveyed from a starting point to a destination point in the building.

The starting door signal is transmitted to at least one control device. The control device defines the building door as the starting building door and the floor level of the building door as the starting floor level for a starting door signal. The control device ascertains for a starting door signal at least one elevator car and defines an elevator door of the elevator car on the starting floor level as a starting elevator door.

This has the particular advantage that a control device which is independent of the elevator control evaluates the starting door signal, implements independent definitions and ascertains an elevator car.

The starting door signal is advantageously only generated if the starting building door is opened from a side remote from starting elevator door and/or if the starting building door is closed from a side facing the starting elevator door so that it is ensured that a passenger is actually moving towards the starting elevator door as the building door opens and/or closes.

Generally, the building comprises at least one electric lighting unit on each floor level. The control device ascertains at least one such electric lighting unit on the route from the starting building door to the starting elevator door and generates at least one switch-on signal for a starting door signal. This is transmitted by the control device to at least one deactivated electric lighting unit on the starting floor level and the respective electric lighting unit on the route from the starting building door to the starting elevator door is activated by the transmitted switch-on signal.

Not only is an elevator car ascertained automatically when a building door opened and/or closed, but also a deactivated lighting unit on the route to the starting elevator door is activated so that the passenger moves safely in bright light towards the elevator car. The electric lighting unit is switched on if a passenger requires it or expects it.

In the case of a plurality of deactivated electric lighting units, these can be activated on the route from the starting building door to the starting elevator door by several virtue of a plurality of transmitted switch-on signals at various distances along the route to the starting building door. Special consideration is to be given to the fact that a deactivated electric lighting unit disposed at the shortest distance along the route to the starting building door is firstly activated by a transmitted switch-on signal and a deactivated electric lighting unit disposed at the greatest distance along the route to the starting building door is lastly activated by virtue of a transmitted switch-on signal. In this manner, only those electric lighting units on the starting floor level which are required by the passenger for the route from the starting building door to the starting elevator door are activated, or electric lighting units are only activated at the point in time when the passenger is in the respective effective range of the electric lighting units.

In the case of a specific embodiment it is provided that the control device for a starting door signal, generates at least one starting request signal and transmits it to the elevator control. The elevator car is moved by the transmitted starting request signal to the starting floor level. As soon as the elevator car has arrived at the starting floor level, the closed starting elevator door is opened. As soon as at least one passenger has entered the elevator car, the opened starting elevator door is closed.

By means of the starting request signal, the control device thus automatically assigns the elevator control with a starting request, so that the passenger does not have to call an elevator car. Therefore, the passenger does not have to halt his movement when entering or leaving the building, in order to make a request on a terminal. Passengers having to stop their movement in this manner find this laborious particularly if they are carrying bags or luggage in both hands. Key pad terminals which are actuated by large numbers of passengers are also not very hygienic.

In an advantageous manner, the transmitted starting request signal activates the elevator control for controlling an elevator drive. The elevator drive which is controlled by the elevator control transports an elevator car to the starting floor level. At least one elevator sensor detects the arrival of the elevator car at the starting floor level and transmits at least one elevator car signal to the elevator control when the arrival of the elevator car at the starting floor level is detected. The transmitted elevator car signal activates the elevator control to control a door mechanism. The door mechanism which is controlled by the elevator control opens the closed starting elevator door. Therefore, the elevator car is moved and the starting elevator door is opened independently of the control device by means of the elevator control.

In an advantageous manner, at least one switch-on signal is transmitted for a starting door signal to at least one deactivated electric lighting unit of the elevator car. In an advantageous manner, the transmitted elevator car signal activates the elevator control, to generate at least one switch-on signal and transmit it to at least one deactivated electric lighting unit of the elevator car. At the latest as soon as the elevator car has arrived at the starting floor level, the deactivated electric lighting unit of the elevator car is activated by the transmitted switch-on signal, so that the electric lighting unit is only activated if a passenger enters the elevator car.

If at least one elevator car sensor detects that at least one passenger has entered the elevator car and transmits at least one elevator car usage signal to the elevator control when it is detected that at least one passenger has entered the elevator car, the transmitted elevator car usage signal can activate the elevator control for controlling the door mechanism. The door mechanism which is controlled by the elevator control closes the opened starting elevator door.

In an advantageous manner, the opening and/or closing of the starting elevator door causes at least one starting elevator door signal to be generated. In an advantageous manner, at least one elevator car door sensor detects the opening and/or closing of the starting elevator door and transmits at least one starting elevator door signal to the elevator control when it is detected that the starting elevator door is opened and/or closed. The elevator control transmits the transmitted starting elevator door signal to the control device. The elevator control thus informs the control device automatically of the successful implementation of the starting request signal in the form of the starting elevator door signal and the control device can thus continue to convey the passenger.

In an advantageous manner, the transmitted elevator door signal activates the control device, to generate at least one switch-off signal and transmit it to the activated electric lighting unit on the starting floor level. The activated electric lighting unit on the starting floor level is deactivated by the transmitted switch-off signal. In an advantageous manner a plurality of activated electric lighting units are deactivated on the route from the starting building door to the starting elevator door by virtue of a plurality of transmitted switch-off signals at various distances along the route to the starting building door. In an advantageous manner, an activated electric lighting unit which is disposed at the shortest distance from the starting building door is firstly deactivated by means of a transmitted switch-off signal and an activated electric lighting unit which is disposed at the greatest distance from the starting building door is deactivated lastly by means of a transmitted switch-off signal. Electric lighting units on the starting floor level thus only remain activated for the time the passenger is located in its effective range.

In an advantageous manner, the control device generates at least one destination request signal which defines a floor level as a destination floor level. In an advantageous manner, the control device defines at least one elevator door of the elevator cabin on the destination floor level as a destination elevator door. The destination request signal can be generated by loading at least one predefined destination request signal or by reason of a destination request made by a passenger or by reason of an identification of a passenger and a destination request signal which is specified for the identified passenger. This has the advantage that the passenger does not have to make or input a destination request.

In an advantageous manner, the destination request signal is transmitted by the control device to the elevator control. The elevator car is moved by the transmitted destination request signal to the destination floor level and at least one closed destination elevator door is opened. In an advantageous manner, the transmitted destination request signal activates the elevator control for controlling the elevator drive. The elevator drive which is controlled by the elevator control moves the elevator car to the destination floor level. At least one elevator sensor detects the arrival of the elevator car at the destination floor level and transmits at least one elevator car signal to the elevator control when the arrival of the elevator car at the destination floor level is detected. The transmitted elevator car signal activates the elevator control for controlling the door mechanism. The door mechanism which is controlled by the elevator control opens the closed destination elevator door. In an advantageous manner, the closed starting elevator door is opened taking into account a freely definable route time of the passenger from the starting building door to the starting elevator door. The passenger is thus conveyed automatically to the destination floor level by the elevator car with a destination request, without making a car request. The starting elevator door is also only opened if the passenger arrives at the starting elevator door on his way from the starting building door. By opening the starting elevator door, the passenger is guided into the elevator car.

In an advantageous manner, the control device generates at least one destination signal, e.g. in that the control device loads at least one predefined destination signal from at least one computer-readable data storage device. The destination signal defines a building door of the destination floor level as a destination building door. In an advantageous manner, the control device ascertains at least one electric lighting unit on the route from the destination elevator door to the target building door.

It is also conceivable that the destination signal is generated by a passenger making at least one destination request. In so doing, the passenger can make at least one destination request on at least one terminal or the passenger is identified and the destination request results from the identification of the passenger. The terminal transmits this destination request to the control device. The control device generates, for this transmitted destination request at least one destination signal.

In an advantageous manner, the elevator control transmits the transmitted elevator car signal to the control device. The transmitted elevator car signal activates the control device, to generate at least one switch-on signal and to transmit it to at least one deactivated electric lighting unit on the route from the destination elevator door to the destination building door. The transmitted switch-on signal activates this deactivated electric lighting unit. When the elevator car arrives at the destination floor level, a deactivated electric lighting unit is thus activated on the route from the destination elevator door to the destination building door so that the passenger is able to pass safely in light conditions to the destination building door.

A plurality of deactivated lighting units on the route from the destination elevator door to the destination building door can be activated by virtue of a plurality of transmitted switch-on signals at various distances along the route to the destination building door. For example, it is conceivable that a deactivated electric lighting unit disposed at the greatest distance along the route to the destination building door is firstly activated by a transmitted switch-on signal and a deactivated electric lighting unit disposed at the shortest distance along the route to the destination building door is lastly activated.

Likewise, a deactivated electric lighting unit can be activated taking into account a lighting-specific activation time.

Therefore, only those electric lighting units of the destination floor level which are required by the passenger to negotiate the route from the destination elevator door to the destination building door are activated, or electric lighting units are specifically only activated at the point in time, at which the passenger is located in the respective effective range of the electric lighting units.

In an advantageous manner, the opening and/or closing of the destination building door causes at least one destination door signal to be generated. For example, the destination building door comprises at least one door sensor which detects the opening and/or closing of the destination building door and transmits a destination door signal to the control device when it is detected that the destination building door has been opened and/or closed. This has the advantage that an independent door sensor generates the destination door signal and said sensor can be disposed in the destination building door and/or in proximity to the destination building door.

In an advantageous manner, the transmitted door signal activates the control device, to generate at least one switch-off signal and transmit it to at least one activated electric lighting unit on the destination floor level. The transmitted switch-off signal deactivates this activated electric lighting unit. A plurality of activated electric lighting units on the route from the destination elevator door to the destination building door can be deactivated by virtue of a plurality of transmitted switch-off signals at various distances along the route to the destination building door. In specific terms, it is conceivable that an activated electric lighting unit disposed at the greatest distance along the route to the destination building door is firstly deactivated by a transmitted switch-off signal and an activated electric lighting unit disposed at the shortest distance along the route to the destination building door is lastly deactivated. All of the activated electric lighting units which are no longer required by the passenger are thus deactivated on the destination floor level, as soon as the passenger has passed through the destination building door.

In a typical manner, the opened destination elevator door is closed as soon as at least one passenger has left the elevator car. For example, an elevator car sensor detects when at least one passenger leaves the elevator car and transmits at least one elevator car usage signal to the elevator control when it is detected that at least one passenger has left the elevator car. The transmitted elevator car usage signal activates the elevator control to control the door mechanism. The door mechanism which is controlled by the elevator control closes the opened destination elevator door.

The elevator car sensor can also detect an absence of passengers in the elevator car and transmit at least one elevator cabin usage signal to the elevator control when an absence of passengers in the elevator car is detected. The transmitted elevator car usage signal activates the elevator control for generating at least one switch-off signal. As soon as there is are no longer any passengers in the elevator car, at least one switch-off signal is transmitted to at least one activated electric lighting unit of the elevator car. The activated electric lighting unit of the elevator car is deactivated by the transmitted switch-off signal.

In an advantageous manner, the control device, at least one door sensor, the elevator control and at least one electric lighting unit are connected to each other via at least one signal line in a network. In an advantageous manner, the control device, the elevator control, at least one elevator sensor, at least one elevator car sensor and at least one elevator car door sensor are connected to each other via at least one signal line in a network. In an advantageous manner, the door sensor transmits the starting door signal or destination door signal via at least one radio network or fixed network to the control device or elevator device.

In an advantageous manner, a computer program product comprises at least one computer program means which is suitable for implementing the method for conveying passengers by virtue of the fact that at least one method step is performed if the computer program means is loaded into at least one processor of the control device. In an advantageous manner, the computer-readable data storage device comprises a computer program product of this type.

In an advantageous manner, an elevator system is retrofitted in a method to create an elevator system in accordance with the invention, in that at least one building door is provided with at least one door sensor, at least one control device is installed and the door sensor, the control device and the elevator control are connected to each other in a network. It is possible to integrate the door sensor into the building door and/or attach it in close proximity to the building door. In an advantageous manner, at least one electric lighting unit is connected in a switchable manner to the network. An existing elevator system can thus be retrofitted conveniently and rapidly to create an elevator system in accordance with the invention.

In an advantageous manner, a building door having an integrated door sensor or a door sensor allocated to the building door is used in the elevator system. In an advantageous manner, the door sensor transmits at least one starting door signal or destination door signal via at least one radio network or fixed network to the control device or elevator device.

DESCRIPTION OF THE DRAWINGS

Exemplified embodiments of the invention will be explained in detail with reference to the Figures, in which:

FIG. 5 shows a flow diagram with method steps of the method for conveying passengers by means of an elevator system in accordance with FIG. 1.

DESCRIPTION OF PREFERRED EMBODIMENTS

Figure 1:
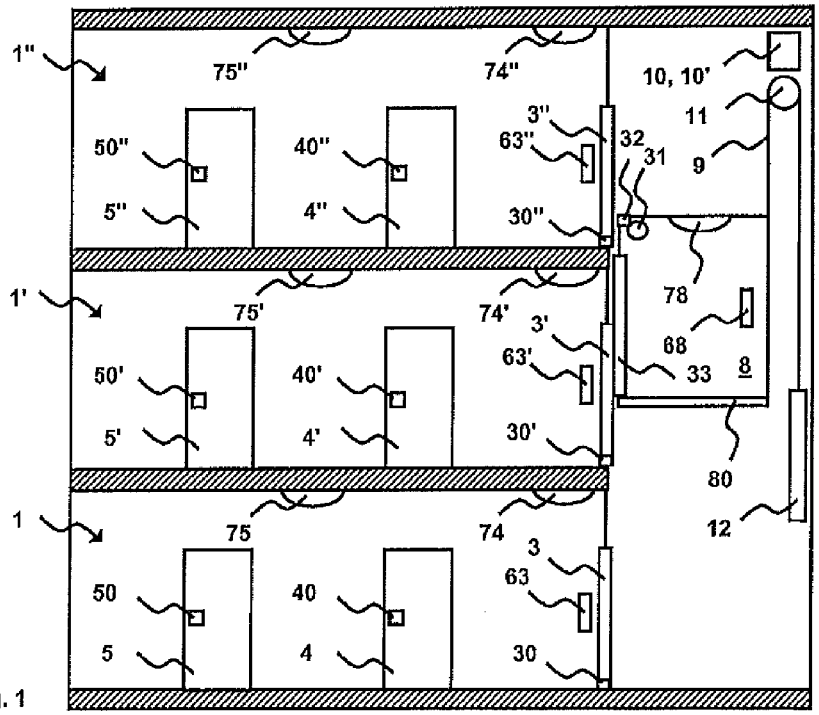
FIG. 1 shows a schematic view of a part of a building with an exemplified embodiment of an elevator system of the invention.

FIG. 1 illustrates a building which comprises a plurality of floor levels 1, 1', 1" having at least one zone, such as a corridor, an apartment, a room, etc. At least one building door 4, 4', 4", 5, 6', 5" is located in the building. The building door 4, 4', 4", 5, 5', 5" is an access door to an apartment in the building and/or an access door to a corridor in the building. In accordance with FIG. 1, two building doors 4, 4', 4", 5, 5', 5" are disposed on each floor level 1, 1', 1". It is not absolutely essential for there to be a zone or a building door 4, 4', 4", 5, 5', 5" on each floor level 1, 1', 1" in other words, an attic floor can be an open terrace without a building door or with only a floor hatch or staircase opening. In principle the term building door is understood to be a zone opening which can be closed and opened and which grants a passenger access to a zone.

Figure 2:
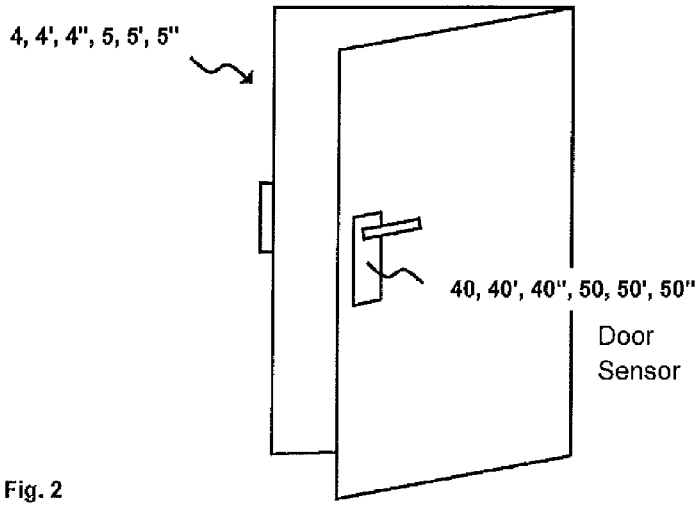
FIG. 2 shows a schematic illustration of a part of a first exemplified embodiment of a building door having a door sensor of the invention in accordance with FIG. 1.
Figure 3:
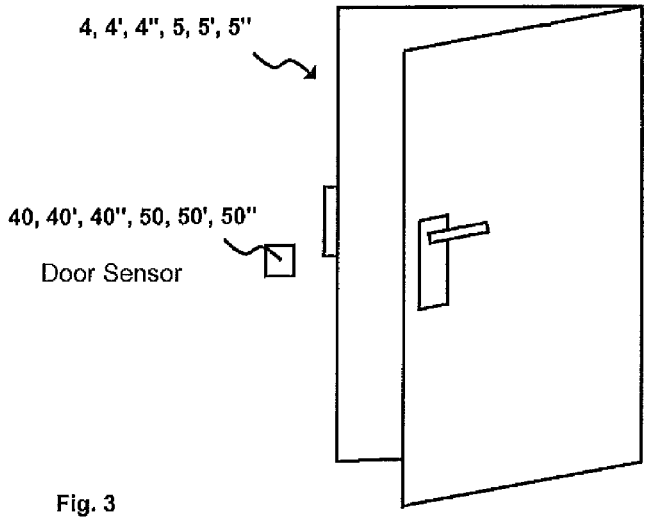
FIG. 3 shows a schematic illustration of a part of a second exemplified embodiment of a building door having a door sensor of the invention in accordance with FIG. 1.

In accordance with FIGS. 2 and 3, the building door 4, 4', 4", 5, 5', 5" comprises at least one door leaf, a door frame and a door threshold. The door leaf comprises a door trim with a door handle and a door latch. The door frame comprises a lock plate. Each building door 4, 4', 4", 5, 5', 5" comprises at least one door sensor 40, 40', 40", 50, 50', 50". The door sensor 40, 40', 40", 50, 50', 50" is attached in and/or to the building door 4, 4', 4", 5, 5', 5".

In accordance with FIG. 2, the door sensor 40, 40', 40", 50, 50', 50" is integrated in a door trim and thus is not visible to passengers from the outside. In accordance with FIG. 3, the first door sensor 40, 40', 40", 50, 50', 50" is at least one key pad which is adjacent to the building door 4, 4', 4", 5, 5', 5" and is easily visible to the passenger. The key pad can be an internal pusher which is attached inside the building or inside an apartment of the building.

The phrase—opening and/or closing a building door 4, 4', 4", 5, 5', 5"—is understood to be a movement of the door leaf relative to the door frame, with the aim of allowing a passenger to step over the threshold. The building door 4, 4', 4", 5, 5', 5" does not need to be fully opened and/or fully closed, on the contrary, a minimum movement of the door leaf relative to the door frame indicates the intention of the passenger to step over the door threshold.

If the building door 40, 40', 40", 50, 50', 50" is closed, the door latch is latched into the lock plate of the door frame. The door latch is released from the lock plate by moving the door handle and the building door 4, 4', 4", 5, 5', 5" can be opened. The door sensor 40, 40', 40", 50, 50', 50" detects the movement of the door handle, for example by means of an electromechanical contact. In a first contact position, the door latch is latched into the lock plate and in a second contact position, the door latch is released from the lock plate. Thus, opening the building door 4, 4', 4", 5, 5', 5" corresponds to a movement of the door handle from a first contact position into a second contact position. Thus, closing the building door 4, 4', 4", 5, 5', 5" corresponds to a movement of the door handle from a second contact position into a first contact position. The door sensor 40, 40', 40", 50, 50', 50" detects this opening or closing of the building door 4, 4', 4", 5, 5', 5" and transmits at least one starting door signal S1 or destination door signal S13 to the control device 10' in accordance with the method steps A1 or A2 explained further below.

Figure 4:
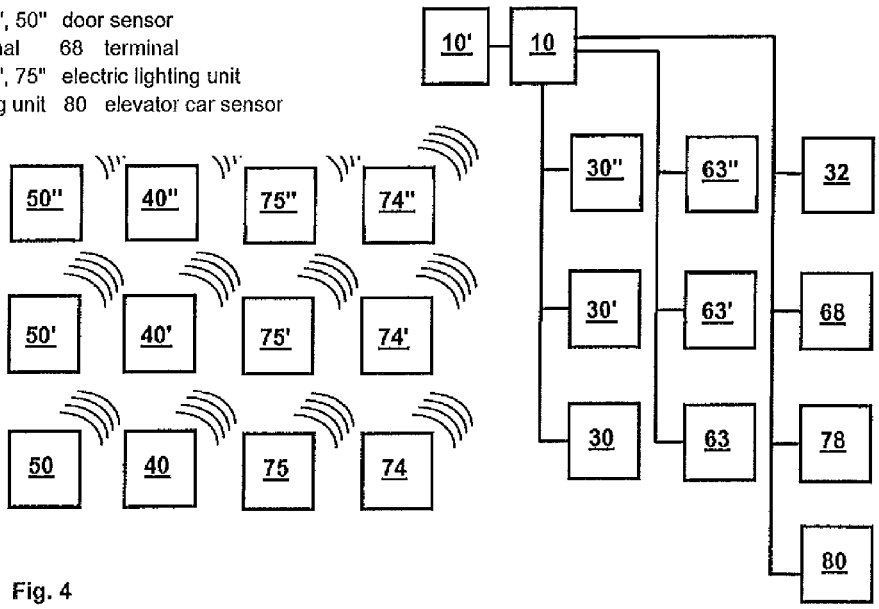
FIG. 4 shows a schematic view of an exemplified embodiment of a network of an elevator system in accordance with FIG. 1.

The exemplified embodiments of the FIGS. 3 and 4 can be combined, so that, for example, it is also possible to provide a key pad as a door sensor on a building door 4, 4', 4", 5, 5', 5". The door sensor 40, 40', 40", 50, 50', 50" can also be a movement detector which is disposed in the door frame of the building door 4, 4', 4", 5, 5', 5" or in a building wall in proximity to the building door 4, 4', 4", 5, 5', 5". It is also possible for the door sensor 40, 40', 40", 50, 50', 50" to be a load-detecting mat which is disposed on the floor of floor level 1, 1', 1" in front of or in proximity to the building door 4, 4', 4", 5, 5', 5". In this case, an opening of the building door 4, 4', 4", 5, 5', 5" is associated with a movement being detected by the movement detector or by a load being detected on the load-detecting mat. In this case, a closing of the building door 4, 4', 4", 5, 5', 5" is associated with no movement being detected by the movement detector or with no load being detected on the load-detecting mat. It is also possible to combine a plurality of door sensors 40, 40', 40", 50, 50', 50" together and accordingly to transmit combined door signals to the control device 10'.

It is evident from FIG. 1 that an elevator system is disposed in the building. The elevator system comprises in one elevator shaft at least one elevator car 8 which is connected to at least one counter weight 12 via at least one supporting means 9. In order to move the elevator car 8 and the counter weight 12, the supporting means 9 is set in motion frictionally engaged by at least one elevator drive 11. At least one passenger has access to the elevator car 8 via at least one elevator door 3, 3', 3". The elevator doors 3, 3', 3" form the boundary of the floor levels 1, 1', 1" to the elevator shaft. The elevator doors 3, 3', 3" are opened and closed via at least one door mechanism 31 which is typically disposed on the elevator car 8 and actuates at least one car door 33. During a stop on a floor level, the car door 33 can be operatively connected to the elevator doors 3, 3', 3" by mechanical coupling such that the car door 33 and the elevator doors 3, 3', 3" are opened and closed simultaneously. The elevator system can comprise more than one elevator car in one elevator shaft or even a plurality of elevator cars in a plurality of elevator shafts.

An elevator control 10 of the elevator system can be disposed at any location in the building. The elevator control 10 comprises at least one processor, at least one computer-readable data storage device and an electrical current supply. At least one computer program means is loaded from the computer-readable data storage device into the processor and is executed. The computer program means controls the movement of the elevator car 8 by means of the elevator drive 11, the opening and closing of the elevator door 3, 3', 3" by means of the door mechanism 31 and the activation and deactivation of the electric lighting unit 78 of the elevator car 8 in accordance with method steps D1 to D8 explained further below.

For safety reasons, the elevator door 3, 3', 3" of a floor level 1, 1', 1" is only opened if an elevator car 8 is located on this floor level 1, 1', 1". In accordance with the method steps E1 or E2 explained further below, at least one elevator sensor 30, 30', 30" detects the arrival of the elevator car 8 at the floor level 1, 1', 1" and transmits at least one elevator car signal S4, S10 to the elevator control 10 for the detected arrival of the elevator cabin 8 at the floor level 1, 1', 1". The transmitted elevator car signal S4, S10 activates the elevator control 10 to control the door mechanism 31. The door mechanism 31 which is controlled by the elevator control 10 opens the elevator door 3, 3', 3" of the floor level 1, 1', 1". As the elevator door 3, 3', 3" is opened, the route time of the passenger from the building door 4, 4', 4", 5, 5', 5" to the elevator door 3, 3', 3" is taken into account, i.e., the elevator door 3, 3', 3" is opened in a manner which is delayed by a freely definable route time, so that it is only possible for a passenger to pass through the door if the passenger has reached it on his route.

The elevator car 8 comprises at least one elevator car sensor 80, e.g. in the form of a load-detecting mat or the like. In accordance with the method steps F1 to F3 explained further below, the elevator car sensor 80 detects when at least one passenger enters or leaves the elevator car 8, and transmits for this purpose at least one elevator car usage signal S6, S15, S16 to the elevator control 10. The transmitted elevator car usage signal S6, S15 activates the elevator control 10 to control the door mechanism 31. The door mechanism 31 which is controlled by the elevator control 10 closes the elevator door 3, 3', 3" of the floor level 1, 1', 1". In accordance with method step G1, at least one elevator car door sensor 32 detects the opening and/or closing of the elevator door 3, 3', 3" and transmits at least one starting elevator door signal S7 to the elevator control 10 when it is detected that the elevator door 3, 3', 3" is opened and/or closed.

On each floor level 1, 1', 1", at least one terminal 63, 63', 63" is disposed in a stationary manner in close proximity to the elevator doors 3, 3', 3". An identical or similar terminal 68 is disposed in a stationary manner in the elevator car 8. The terminal 63, 63', 63" comprises at least one stationary request input device and at least one stationary output device. The terminal 63, 63', 63" is mounted e.g. on a building wall or elevator car wall or is located separately in a zone in front of the elevator door 3, 3', 3".

At the request input device of the terminal 63, 63', 63", 68 the passenger can make a destination request in a manner known per se e.g. by pressing respective keys or actuating a touch-sensitive screen. The input can directly designate the destination floor level or can be an identification code. The identification code can also be transmitted in a contact-free manner, in that the terminal interacts in a manner known per se with a mobile identification device carried by the passenger and the identification code is read out. The identification code produces the destination request in a manner known per se. Irrespective of the way the destination request has been made, the passenger receives on the output device an optical and/or acoustic confirmation of the destination request made. The input destination request is transmitted to the control device 10'. The control device 10' comprises at least one computer-readable data storage device and at least one processor. At least one computer program product can be loaded from the computer-readable data storage device into the processor and generates a destination request signal S9 for the transmitted destination request.

The electric lighting units 74, 74', 74", 75, 75', 75" of the floor levels 1, 1', 1" and the electric lighting unit 78 of the elevator car 8 are known lights which are operated by electrical current and are mounted permanently on ceilings, walls or floors of the floor levels 1, 1', 1" and the elevator car 8. The electric lighting units 74, 74', 74", 75, 75', 75", 78 can be activated and deactivated by switches, in that an electrical circuit is closed or opened via the respective switch.

During activation or deactivation of the electric lighting units 74, 74', 74", 75, 75', 75", 78 their luminous characteristic is taken into account, i.e., lights which do not achieve their operating brightness until several seconds after activation are switched earlier by a freely definable, lighting-specific activation time, so that the brightness is ensured in the building if required by the passenger.

The electric lighting units 74, 74', 74", 75, 75', 75", 78 are activated or deactivated in accordance with the method steps C1 to C6 explained further below. In the case of electric lighting units 74, 74', 74", 75, 75', 75", 78 which do not achieve their operating brightness until several seconds after activation, the activation can be performed earlier by a freely definable, lighting-specific activation time, so that the brightness is ensured in the building if required by the passenger.

FIG. 4 illustrates a network of the elevator system. The elevator sensors 30, 30', 30" of the elevator shaft and of the terminal 63, 63', 63" of the floor levels 1, 1', 1" and a terminal 68 of the elevator car 8, the car sensor 80, the elevator car door sensor 32 and an electric lighting unit 78 of the elevator car 8 are connected to the elevator control 10 via a fixed network. Door sensors 40, 40', 40", 50, 50', 50" of the building doors 4, 4', 4", 5, 5', 5" and electric lighting units 74, 74', 74", 75, 75', 75" of the floor levels 1, 1', 1" are connected to a control device 10' via a fixed network. The electric lighting units 74, 74', 74", 75, 75', 75" can be activated or deactivated via fixed network-actuated switches. The fixed network-actuated switches are designed in such a manner that an already activated electric lighting unit and electric lighting units 74, 74', 74", 75, 75', 75" continue to be activated or deactivated by means of a switch-on signal S2, S12 or switch-off signal S8, S17 transmitted on a further occasion. Each component of the network can be unequivocally identified via a network identification number. Therefore, each door sensor 40, 40', 40", 50, 50', 50" in each building door 4, 4', 4", 5, 5', 5" can be identified individually and each electric lighting unit 74, 74', 74", 75, 75', 75" on each floor level 1, 1', 1" can be identified individually.

Known radio networks are Wireless Local Area Network (WLAN) in accordance with the Standard IEEE802.11 or Worldwide Interoperability for Microwave Access (WIMAX) in accordance with the Standard IEEE802.16. Both the fixed network and also the radio network permit bidirectional communication in accordance with known and tried and tested network protocols such as the Transmission Control Protocol/Internet-Protocol (TCP/IP) or Internet Packet Exchange (IPX). The fixed network comprises at least one electrical or optical signal line which is routed in the building e.g. underneath plastering or is even suspended in the elevator shaft. Of course, the elevator sensors 30, 30', 30" of the elevator shaft and the terminals 63, 63', 63" of the floor levels 1, 1', 1" and a terminal 68 of the elevator car 8, the car sensor 80, the elevator car door sensor 32 and the electric lighting unit 78 of the elevator car 8 are connected to the elevator control 10 via a radio network. Equally, it is also possible to connect the door sensors 40, 40', 40", 50, 50', 50" of the building doors 4, 4', 4", 5, 5', 5" and electric lighting units 74, 74', 74", 75, 75', 75" of the floor levels 1, 1', 1" to the control device 10' via a fixed network.

The control device 10' comprises at least one processor and at least one computer-readable data storage device. At least one computer program means is loaded from the computer-readable data storage device into the processor and is executed. The computer program means controls the determination of the elevator car 8, the determination of the at least one electric lighting unit 74, 74', 74", 75, 75', 75", the generation and transmission of the starting request signal S3, the activation and deactivation of the electric lighting unit 74, 74', 74", 75, 75', 75", the generation and transmission of the destination request signal S9, the generation of the destination signal in accordance with the method steps B1 to B8. The control device 10' ascertains a passenger-specific route time allowance and transmits it as part of the starting request signal S3 to the elevator control 10. The elevator control 10 opens the starting elevator door in the method step D3 only after expiry of this route time. The route time allowance can be predefined in a passenger-specific manner similarly to the destination request signal S9 in the computer-readable data storage device and can be changed by the passenger.

The control device 10' can be accommodated in a dedicated housing with an electrical current supply. However, the control device 10' can also be a slide-in part of the elevator control 10 and can be supplied with electrical current from the electrical current supply of the elevator control 10. By reason of this distinctive communication between the control device 10' and the elevator control 10, knowledge of the present invention ensures that a starting door signal S1 or a destination door signal S13 can be transmitted by the door sensor 40, 40', 40", 50, 50', 50" both to the control device 10' and also to the elevator control 10. In a similar manner, at least one elevator car signal S4, S10 can thus be transmitted by the elevator sensor 30, 30', 30" both to the control device 10' and also to the elevator control 10, and an elevator car usage signal S6, S15, S16 can be transmitted by the elevator car usage sensor 80 to the control device 10' and also to the elevator control 10.

FIG. 5 illustrates a flow diagram with method steps of the method for conveying passengers by means of the elevator system. In the method steps A1 and A2, a door sensor 40, 40', 40", 50, 50', 50" generates at least one starting door signal S1 or at least one destination door signal S13 and transmits it to the control device 10'.

In the method step B1, the control device 10' defines the building door 4, 4', 4", 5, 5', 5" of the particular door sensor 40, 40', 40", 50, 50', 50" which has transmitted the starting door signal S1 to the control device 10', as a starting building door. The control device 10' defines the floor level 1, 1', 1" of this building door 4, 4', 4", 5, 5', 5" as a starting floor level. The control device 10' defines an elevator door 3, 3', 3" of an elevator car 8 on this starting floor level as a starting elevator door. The control device 10' ascertains at least one electric lighting unit 74, 74', 74", 75, 75', 75" on the route from the starting building door to the starting elevator door.

In the method step B2, the control device 10' generates for a transmitted starting door signal S1 at least one switch-on signal S2 and transmits it to ascertained electric lighting unit 74, 74', 74", 75, 75', 75".

In the method step B3, the control device 10' generates for a transmitted starting door signal S1 at least one starting request signal S3 and transmits it to the elevator control 10.

In the method step B4, the control device 10' generates for a transmitted starting elevator door signal S7 at least one switch-off signal S8 and transmits it to ascertained electric lighting unit 74, 74', 74", 75, 75', 75".

In the method step B5, the control device 10' generates for a transmitted starting door signal S1 at least one destination request signal S9. The destination request signal S9 defines a floor level 1, 1', 1" as a destination floor level. The destination request signal S9 defines at least one elevator door 3, 3', 3" of the elevator car 8 as a destination elevator door.

In the method step B6, the control device 10' generates at least one destination signal. The destination signal defines a building door 4, 4', 4", 5, 5', 5" of the destination floor level as a destination building door. The control device 10' ascertains at least one electric lighting unit 74, 74', 74", 75, 75', 75" on the route from the destination elevator door to the destination building door.

In the method step B7, the control device 10' generates for a transmitted elevator car signal S10 at least one switch-on signal S12 and transmits it to the ascertained electric lighting unit 74, 74', 74", 75, 75', 75".

In the method step B8, the control device 10' generates, for a transmitted destination door signal S13 at least one switch-off signal S14 and transmits it to ascertained electric lighting unit 74, 74', 74", 75, 75', 75".

In the method steps C1, C2 and C4, at least one deactivated electric lighting unit 74, 74', 74", 75, 75', 75", 78 is activated by at least one transmitted switch-on signal S2, S5 and S12. The lighting-specific activation time of the electric lighting unit 74, 74', 74", 75, 75', 75" can be taken into account by the control device 10' or by the elevator control 10 or by the radio network actuated switches. In the method steps C3, C5 and C6, at least one activated electric lighting unit 74, 74', 74", 75, 75', 75", 78 is deactivated by at least one transmitted switch-off signal S8, S14 and S17.

In the method step D1, the elevator control 10 controls the elevator drive 11 for a transmitted starting request signal S3. The elevator drive 11 which is controlled by the elevator control 10 transports the elevator car 8 to the starting floor level. In the method step D2, the elevator control 10 generates for a transmitted elevator car signal S4 at least one switch-on signal S5 and transmits it to at least one deactivated electric lighting unit 78.

In the method step D3, the elevator control 10 controls the door mechanism 31 for a transmitted elevator car signal S4. The door mechanism 31 which is controlled by the elevator control 10 opens the closed starting elevator door. The closed starting elevator door is opened taking into account a freely definable route time of the passenger from the starting building door to the starting elevator door.

In the method step D4, the elevator control 10 controls the door mechanism 31 for a transmitted elevator car usage signal S6. The door mechanism 31 which is controlled by the elevator control 10 closes the opened starting elevator door.

In the method step D5, a destination request signal S9 is transmitted to the elevator control 10. The elevator control 10 controls the elevator drive 11 for a transmitted destination request signal S9. The elevator drive 11 which is controlled by the elevator control 10 transports the elevator car 8 to the starting floor level. In the method step D6, the elevator control 10 controls the door mechanism 31 for a transmitted elevator car signal S10. The door mechanism 31 which is controlled by the elevator control 10 opens the closed destination elevator door.

In the method step D7, the elevator control 10 is activated for a transmitted elevator car usage signal S15, to control the door mechanism 31. The door mechanism 31 which is controlled by the elevator control 10 closes the opened destination elevator door.

In the method step D8, the elevator control 10 generates for a transmitted elevator car usage signal S16 at least one switch-off signal S17 and transmits it to at least one activated electric lighting unit 78.

In the method steps E1 and E2, an elevator sensor 30, 30', 30" generates at least one elevator car signal S4, S10 and transmits it to the elevator control 10.

In the method steps F1, F2 and F3, an elevator car usage sensor 80 generates at least one elevator car usage signal S6, S15, S16 and transmits it to the elevator control 10.

In the method step G1, an elevator car door sensor 32 generates at least one starting elevator door signal S7 and transmits the starting elevator door signal S7 to the elevator control 10. The elevator control 10 transmits the transmitted starting elevator door signal S7 to the control device 10'.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method, comprising:

determining a starting floor level in a building based on a received movement signal for a building door in the building;

identifying a lighting unit along a path in the starting level floor between the building door and an elevator door on the starting floor level; and activating the identified lighting unit.

2. The method of claim 1, the identified lighting unit being activated based on an activation time for the lighting unit.

3. The method of claim 1, further comprising activating an additional lighting unit along the path, the additional lighting unit being closer to the elevator door than the identified lighting unit.

4. The method of claim 1, further comprising:

deactivating the identified lighting unit; and deactivating the additional lighting unit after deactivating the identified lighting unit.

5. The method of claim 1, further comprising deactivating the identified lighting unit.

6. The method of claim 5, the deactivating being performed after a passenger boards an elevator through the elevator door.

7. The method of claim 1, further comprising opening the elevator door after a defined route time from the building door to the elevator door has elapsed.

8. The method of claim 1, further comprising opening the elevator door after a passenger-specific route time from the building door to the elevator door has elapsed.

9. The method of claim 8, the passenger-specific route time having been previously defined by a passenger.

10. The method of claim 1, further comprising generating an elevator destination signal based on the movement signal for the building door.

11. A method, comprising:

determining that a building door on a building floor has been opened for a person;

defining the building floor as a starting floor;

sending an elevator cabin to an elevator door at the starting floor to receive the person; and activating a lighting unit arranged between the building door and the elevator door.

12. The method of claim 11, further comprising entering a predefined elevator destination for the person.

13. The method of claim 11, further comprising determining that the lighting unit is located on or near a path between the building door and the elevator door.

14. The method of claim 11, further comprising:

receiving identifying information for the person; and opening the building door for the person based on the identifying information.

15. A computer-readable data storage device having encoded thereon instructions that, when executed by a processor, cause the processor to:

determine that a building door on a building floor has been opened for a person;

define the building floor as a starting floor;

send an elevator cabin to an elevator door at the starting floor to receive the person; and activate a lighting unit arranged between the building door and the elevator door.

16. The computer-readable data storage device of claim 15, the instructions further causing the processor to activate an additional lighting unit arranged between the building door and the elevator door after the lighting unit is activated.

17. A computer-readable data storage device having encoded thereon instructions that, when executed by a processor, cause the processor to:

determine a starting floor level in a building based on a received movement signal for a building door in the building;

identify a lighting unit along a path in the starting level floor between the building door and an elevator door on the starting floor level; and activate the identified lighting unit.

18. The computer-readable data storage device of claim 17, further comprising deactivating the determined lighting unit.

19. A system, comprising:

a door sensor for a building door in a building;

an elevator installation;

a lighting unit; and a control device, the control device comprising a processor and a data storage device, the data storage device having encoded thereon instructions that, when executed by the processor, cause the processor to, determine a starting floor level in the building based on a received door movement signal from the door sensor, determine that the lighting unit is along a path in the starting level floor between the building door and an elevator door of the elevator installation on the starting floor level, and activate the lighting unit.

20. The system of claim 19, further comprising an elevator terminal coupled to the control device.

* * * * *